US005342575A

United States Patent [19]

Nagai

[11] Patent Number: 5,342,575

[45] Date of Patent: Aug. 30, 1994

[54] PROCESS FOR PRODUCING BILLET OF POWDERY ALLOY BY SPECIAL ARRANGEMENT OF POWDERS

[75] Inventor: Yoshitaka Nagai, Toyama, Japan

[73] Assignee: Yoshida Kogyo K.K., Tokyo, Japan

[21] Appl. No.: 93,867

[22] Filed: Jul. 20, 1993

[30] Foreign Application Priority Data

Aug. 11, 1992 [JP] Japan ..... 4-214280
Aug. 11, 1992 [JP] Japan ..... 4-214281

[51] Int. Cl.[5] ..... B22F 1/00; B21C 23/00

[52] U.S. Cl. ..... 419/67; 419/62; 419/30; 419/41; 72/253.1; 29/DIG. 47

[58] Field of Search ..... 419/23, 30, 41, 38, 419/48, 43, 67, 69, 62; 72/352.1; 29/DIG. 47

[56] References Cited

U.S. PATENT DOCUMENTS 3,766,766 10/1973 Fuchs, Jr. et al. ..... 72/253.1
3,766,768 10/1973 Fuchs, Jr. et al. ..... 72/253.1
3,766,769 10/1973 Fuchs, Jr. et al. ..... 72/253.1
3,767,368 10/1973 Fuchs, Jr. et al. ..... 72/253.1
4,587,096 5/1986 Mankins et al. ..... 419/27

OTHER PUBLICATIONS

Akechi, Patent Abstracts of Japan, Kokai App. No. 61-159756.

*Primary Examiner*—Donald P. Walsh
*Assistant Examiner*—Anthony R. Chi
*Attorney, Agent, or Firm*—Finnegan, Henderson, Farabow, Garrett & Dunner

[57] ABSTRACT

Billets are produced from powdery alloys by a process which comprises densely packing in a can a powdery metal or alloy easy of plastic working and a powdery alloy difficult of plastic working in that order, sealing hermetically the can and thereafter degassing the same; or a process which comprises densely packing a powdery alloy difficult of plastic working in a can and, then, densely packing a powdery metal or powdery alloy easy of plastic working in the can to make the powdery metal or alloy into a lid of the can, wherein the powdery alloy easy of plastic working is coarse powder, while the powdery alloy difficult of plastic working is fine powder, and the powdery alloy is a rapidly solidified powdery alloy comprising an Al-base, Mg-base, Ni-base, Ti-base or Fe-base alloy. The billets obtained by the above process can be easily subjected to plastic working to provide worked articles having with excellent mechanical characteristics, such as high strength and high hardness, without deteriorating the properties of the starting powder materials.

18 Claims, 5 Drawing Sheets

PROCESS FOR PRODUCING BILLET OF POWDERY ALLOY BY SPECIAL ARRANGEMENT OF POWDERS

BACKGROUND OF THE INVENTION

1. Field of the Invention

The present invention relates to an improved process for producing a billet of powdery alloys to be used for plastic working of the powdery alloys.

2. Description of the Prior Art

In the conventional processes for the production of a shaped article from a powdery alloy by plastic working, the powdery alloy was packed in a can having a prescribed capacity, uniformly compacted and degassed to give a billet, which was heated if necessary and subjected to plastic working, such as extrusion, forging or rolling, to produce a worked article.

The extrusion in the aforestated prior art will now be described by way of example. In the initial stage of the extrusion, the extrusion pressure is at its maximum but is lowered upon the commencement of the extrusion of a material. Although a powdery alloy which is easily subjected to extrusion has been made into a satisfactory billet by the conventional process, the use of a powdery alloy difficult of extrusion, such as a rapidly solidified powdery alloy, for achieving a high quality, such as high strength or high hardness, makes the initial extrusion pressure extraordinarily high, thus limiting the working on an ordinary plastic working machine (extruder) or a die. In addition,the working temperature raised for facilitating the plastic working has caused the problem of deterioration of the mechanical characteristics of the billet to be produced, such as strength and hardness, owing to a change in the properties of the rapidly solidified powdery alloy. Moreover, a powder usually produced by the atomizing process is not uniform and, thus, classified on a classifier into fine powder and coarse powder, the former being used for producing a high-grade product, while the latter for a low-grade product or being discarded.

Further, after being packed into a can, the powdery alloy is usually subjected to heating, degassing and compacting in a hot press. However, there is the disadvantage that the compacted powder is adulterated with a gas such as air when taken out of the hot press for carrying out plastic working.

In order to overcome the above-mentioned disadvantage, there has heretofore been adopted a method, as shown in FIG. 10, which comprises packing a powdery alloy 12 in a can 11, sealing hermetically the can with a lid 13 having an exhaust gas pipe 14 for degassing by welding 15 or the like, degassing the powdery alloy through the exhaust gas pipe 14 while heating the billet, and flattening the exhaust gas pipe 15 after the completion of degassing to prevent a gas such as air from returning into the billet. However, the welding of the lid after the packing of the powdery alloy raises the temperature of the rapidly solidified powdery alloy in the can to a temperature higher than a prescribed value (for example, 400° C.) owing to the heat of welding and, in some case, substantial deterioration in the mechanical characteristics such as strength and hardness occurs after working, thereby causing problems in practical applications.

SUMMARY OF THE INVENTION

The present invention enables all of the powdery alloys produced to be effectively utilized so as to facilitate plastic working while maintaining the characteristics of the powder by varying the powders to be packed in a can.

The present invention relates to a process for producing a billet of powdery alloys which comprises densely packing a powdery metal or alloy readily plastically deformable and then a powdery alloy difficult to plastically deform in that order in a can, sealing hermetically the can and thereafter degassing the same.

In the preferred embodiment, the powdery metal or alloy readily plastically deformable and the powdery alloy difficult to plastically deform coexist gradiently with respect to the content thereof in a boundary thereof. Compacting of the powdery metals and alloys is conducted after or during the degassing.

The present invention further relates to a process for producing a billet of powdery alloys which comprises densely packing a powdery alloy difficult to plastically deform in a can and then densely packing a powdery metal or alloy readily plastically deformable in the can. The powdery metal or alloy easy of plastic working serves as a lid of the can.

In an embodiment, after packing the powdery metal or the powdery alloy readily plastically deformable in the can, the can is heated and pressurized from the packing side of the powdery metal or alloy readily plastically deformable to densely maintain the powdery alloy difficult to plastically deform within the can and the powdery metal or the powdery alloy readily plastically deformable. Thereafter, degassing is conducted through the lid. Also, in the process, degassing and compacting may be simultaneously performed with and after the above-mentioned heating and pressurizing.

In a further aspect of the present invention, an extruded article is obtained by densely packing a powdery alloy difficult to plastically deform and then a powdery metal or powdery alloy readily plastically deformable in a can to make the powdery metal or powdery alloy readily plastically deformable into a lid of the can, degassing and compacting to provide a billet and extruding the resultant billet from the side of the powdery metal or powdery alloy readily plastically deformable.

DETAILED DESCRIPTION OF THE PREFERRED EMBODIMENTS

Figure 1:
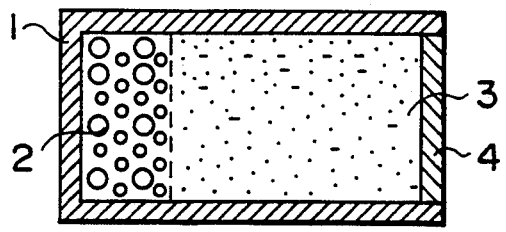
FIG. 1 is an explanatory drawing showing an example of the present invention.

The powdery alloy as the object of a powder, which is difficult to plastically deform, in the present invention is exemplified by, though not limited to, a rapidly solidified powdery alloy consisting of an amorphous phase, a microcrystalline phase or a mixed phase thereof and made of any one of Al-base, Mg-base, Ni-base, Ti-base and Fe-base alloys or a combination of at least two of them. As typical examples of the rapidly solidified powder alloys, there may be mentioned Al-Ni-Mm, Al-Ni-Mm-Zr, Al-Ni-Zr, Al-Ni-Ti, Mg-Ni-Ce, Ni-Si-B, and the like where Mm represents misch metal.

The use of a powdery alloy difficult to plastically deform as the primary material is intended to improve and stabilize the characteristics of the product made therefrom.

Although the powdery metal or powdery alloy easy of plastic working to be used in the present invention can be exemplified by the alloys available generally or in the market, such as pure Al, 6063 alloy (aluminum alloy designated by Japanese Industrial Standards) and duralumin, any rapidly solidified alloy can be employed so far as it is easy to deform under heating and pressurizing.

The powdery metal or powdery alloy which can be easily subjected to plastic working may be prepared as a mixture of a rapidly solidified powder with a commercially available alloy powder.

The powdery metal or alloy readily plastically deformable is used in a relatively coarse powder form, while the powdery alloy difficult to plastically deform is used in a relatively fine powder form. Specifically, a powder having an average particle size larger than 100 μm is regarded as the coarse powder, while a powder having an average particle size smaller than 100 μm, desirably 80 μm, more desirably 50 μm is regarded as the fine powder.

The form of packing of the coarse and fine powders in a can is typified by FIG. 1 to FIG. 4. FIG. I may be deemed to be of two-stage type, wherein the coarse powder 2 is packed in the vicinity of a bottom lid of a can 1, subsequently the fine powder 3 is placed thereon and a top lid 4 is placed thereon.

Figure 2:
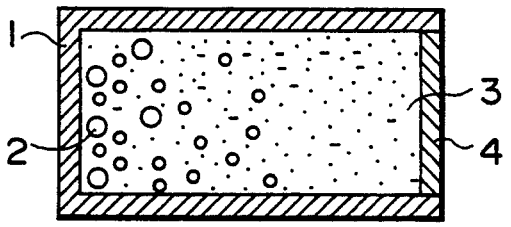
FIG. 2 is an explanatory drawing showing another example of the present invention.

FIG. 2 may be deemed to be of gradient type, wherein the coarse powder 2 is packed in the vicinity of a bottom lid of a can 1, successively a mixed layer of the coarse and fine powders is packed in such a manner that the content of the fine powder 3 increases gradiently and a top lid 4 is placed thereon.

Figure 3:
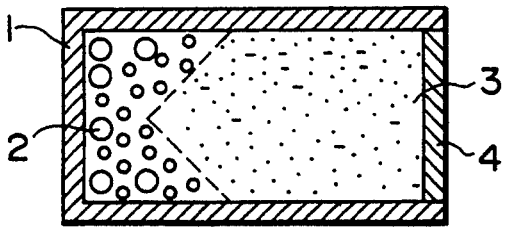
FIG. 3 is an explanatory drawing showing still another example of the present invention.

FIG. 3 may be deemed to be of modified gradient type, wherein the coarse powder 2 is packed to form a valley, while the fine powder 3 is packed to form a mountaintop and a top lid 4 is placed thereon.

Figure 4:
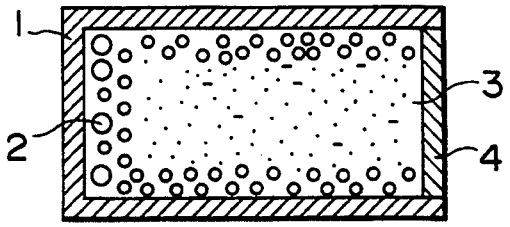
FIG. 4 is an explanatory drawing showing a further example of the present invention.

FIG. 4 is the type, wherein the coarse powder 2 is packed along the inside wall of a can 1, while the fine powder 3 is packed in the middle part thereof and a top lid 4 is placed thereon. This type is particularly suited for forging and rolling.

FIGS. 6 to 9 show the production procedure of a further example according to the present invention wherein the fine powdery alloy 3 difficult to plastically deform is densely packed in a can I and, then, the coarse powder 2 readily plastically deformable is densely packed in the can 1. Since the coarse powder 2 serves as a lid for sealing the can 1, any lid, as shown at reference numeral 4 in FIGS. 1 to 4, is not required.

The above-described method can reduce the processing pressure in the initial stage of plastic working and facilitate the plastic working on an ordinary plastic working machine or a die.

Now, the present invention will be specifically described with reference to the Examples and Comparative Examples.

EXAMPLE 1, REFERRING TO FIG. 5

Billet a was prepared as a comparative sample by packing a 6063 alloy can having diameter of 41 mm and a length of 120 mm with a rapidly solidified microcrystalline fine powder consisting of an Al-Ni-Mm alloy difficult of plastic working (having an average particle size of 40 μm, hereinafter referred to as the alloy powder B) in a depth of 120 mm. Then, billet b was prepared by packing a similar can with 6063 alloy readily plastically deformable (having an average particle size of 100 μm, hereinafter referred to as the alloy powder A) in a depth of 20 mm, then with a mixture of the alloy powder B with the alloy powder A in a depth of 20 mm in such a manner that the content of the alloy powder A decreased gradiently, and further with the alloy powder B in a depth of 80 mm.

The billets a and b were degassed at 400° C., compacted to a compacting density of 98%, heated to 360° C. and extruded at an extrusion ratio of 15.

The procedure of preparing the above-mentioned billet b was repeated to prepare billet c except that a rapidly solidified microcrystalline coarse powder consisting of an Al-Ni-Mm alloy readily plastically deformable (having an average particle size of 100 μm, hereinafter referred to as the alloy powder C) was used in place of the alloy powder A, and a similar can was packed with the alloy powder C in place of the alloy powder A in a depth of 10 mm, then with a mixture of the alloy powder B with the alloy powder C as the gradient layer in a depth of 100 mm, and further with the alloy powder B in a depth of 10 mm. The resultant billet c was extruded under the same conditions as the above.

Further, billet d was prepared by packing a similar can with the alloy powder A in a depth of 20 mm and, then, with a rapidly solidified microcrystalline fine powder consisting of an Al-Ni-Mm-Zr alloy difficult to plastically deform (having an average particle size of 40 μm, hereinafter referred to as the alloy powder D) so that the alloy powder D forms a mountaintop with an angle of about 90° as shown in FIG. 3.

Billet e was prepared by packing a similar can with the alloy powder D alone.

Attempts were made to extrude billets d and e in a similar manner to the extrusion of the abovementioned billets a, b, and c. However, the billet e could not be extruded because of its resistance to plastic deformation. The test results for the billets a, b, c and d are given in Table 1.

TABLE 1

| | Max. extrusion pressure (kgf/mm²) | Strength (kgf/mm²) | | | Hardness (Hv) | | |
|---|---|---|---|---|---|---|---|
| | | front end | middle | rear end | front end | middle | rear end |
| Billet a | 120 | 95 | 92 | 90 | 243 | 240 | 235 |
| Billet b | 92 | 25 | 90 | 93 | 89 | 235 | 240 |
| Billet c | 102 | 74 | 87 | 92 | 214 | 228 | 240 |
| Billet d | 96 | 24 | 89 | 91 | 92 | 235 | 244 |

Figure 5:
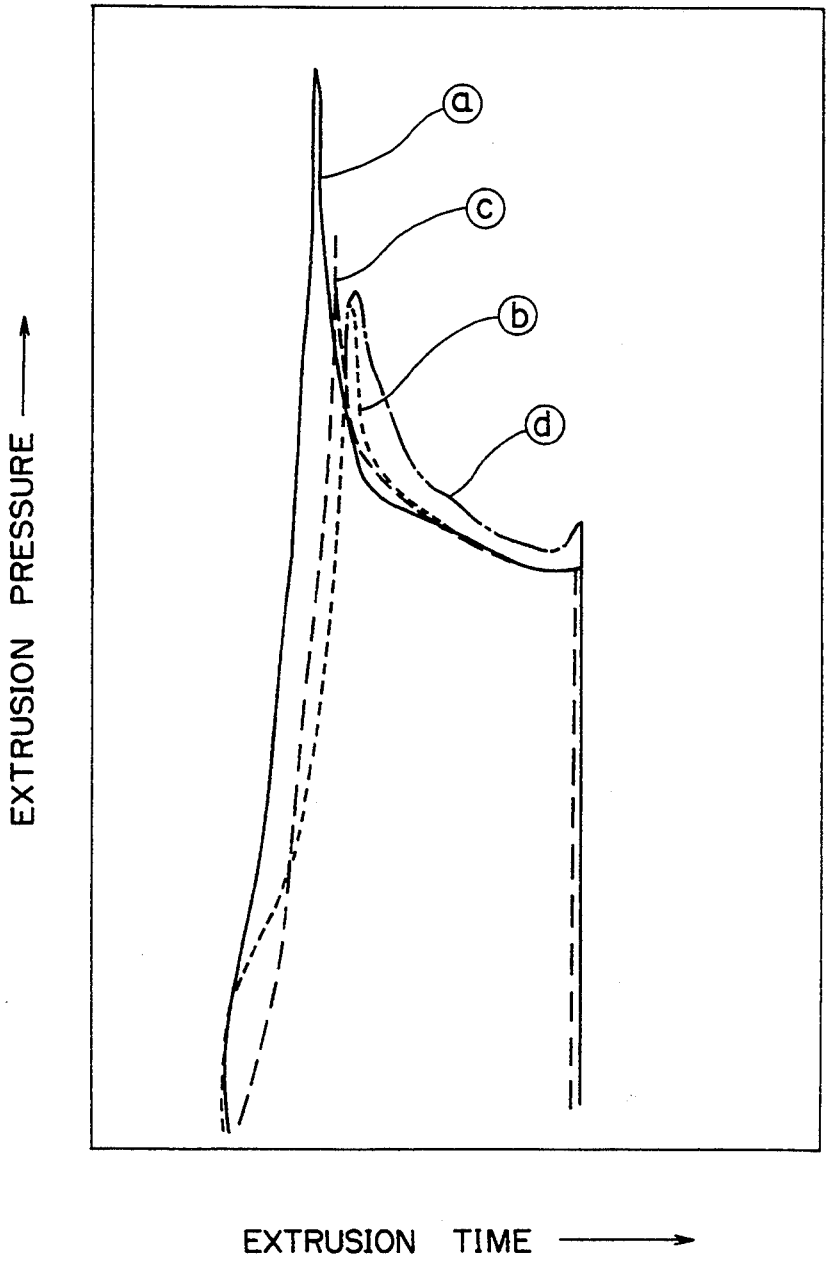
FIG. 5 is a graph showing the relationship between the extrusion time and the extrusion pressure in the Examples of the present invention and Comparative Example.

The relationship between the extrusion time and the extrusion pressure in the above test is given in FIG. 5, from which it is apparent that the process according to the present invention greatly decreases the initial extrusion pressure.

EXAMPLE 2

Figure 6:
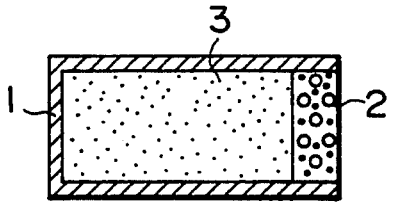
FIGS. 6 to 9 are illustrations showing the productional procedure of a still further example of the present invention.

As shown in FIG. 6, a 6063 alloy can 1 having a diameter of 41 mm and a length of 120 mm was packed with a rapidly solidified microcrystalline fine powder 3 consisting of an Al-Ni-Mm alloy, which is difficult to plastically deform, in a depth of 100 mm and, then, with a coarse powder 2 consisting of 6063 alloy, which is easily subjected to plastic working, in a depth of 20 mm.

Figure 7:
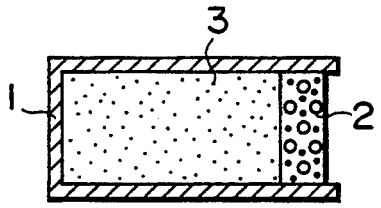
Figure 8:
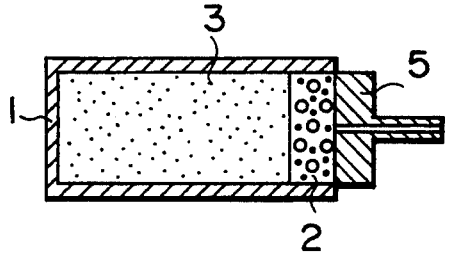
Figure 9:
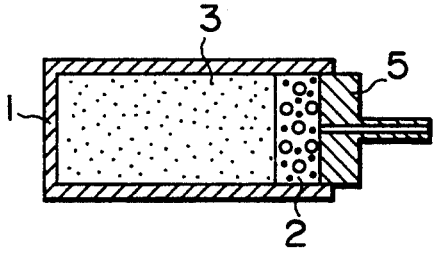

As shown in FIGS. 8 and 9, a degassing member 5 having an outside configuration nearly the same as the inside configuration of the can 1 was pressed against the can 1 at the opening thereof (the powder readily plastically deformable) under heating to 360° C. and pressurizing to degas and compact the powder and prepare a billet having a compacted powder density of 98% as shown in FIG. 7. In the above-mentioned treatment of compacting the powder, the can 1 was placed in a container and, therefore, the outer surface thereof was not deformed; and besides the powder readily plastically deformable was crushed and fused by the heating and pressurizing to serve as a lid for sealing the can 1.

Figure 10:
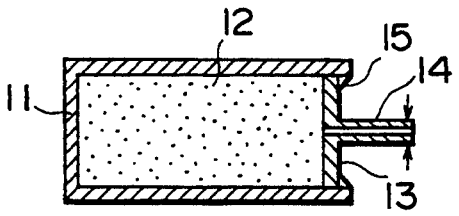
FIG.10 PRIOR ART
FIG. 10 is an explanatory drawing showing a conventional process.

The billet thus obtained was heated to 360° C. and extruded at as extrusion ratio of 15 from the side of the powder readily plastically deformable. The product thus obtained has characteristics superior to those of the one prepared by the conventional method as shown in FIG. 10 and was free from the partial deterioration of characteristics as observed in the conventional method.

The use of any of Mg-base, Ni-base, Ti-base and Fe-base powdery alloy brings about the results similar to those obtained in the aforesaid example in which the Al-Ni-Mm powdery alloy was used. The coarse powder of 6063 alloy serving as the lid in the example may be replaced with pure A1 powder, duralmin powder or a mixture of any of these powders with the rapidly solidified microcrystalline coarse powder alloy consisting of the Al-Ni-Mm alloy.

In Example 2, a can was successively packed with a powdery alloy difficult to plastically deform and a powder readily plastically deformable in that order and heated from the side of the powder readily plastically deformable (from the opening side of the can) at a temperature lower than that in the preceding example under pressure to temporarily maintain the alloy powder difficult to plastically deform in the can, while the powder readily plastically deformable was sintered. Then, in a similar manner to that of the preceding example, a degassing member was pressed against the can under heating and pressurizing to degas and compact the powder. By such a two-stage treatment, it is possible to relatively lower the heating temperature, shorten the treatment time and suppress a deterioration in the characteristics of the rapidly solidified powder.

The powder readily plastically deformable to be employed is preferably coarse powder having a spherical shape.

According to the process of Example 2, it is possible to sufficiently carry out degassing without welding a lid to a billet and easily produce a billet of a powder alloy packed in a can as the compacted material. In addition, since the powdery alloy is not affected by the heat of welding, the characteristics of the powdery alloy is not deteriorated after plastic working.

According to the process of the present invention, it is possible to facilitate the processing of a rapidly solidified fine alloy powder that has been believed to be difficult to plastically deform and, at the same time, to produce a plastically worked member having excellent mechanical characteristics such as high strength and high hardness from the alloy powder, since the initial processing pressure can be suppressed, heat buildup due to working is reduced and, thus, the properties of the alloy powder are not deteriorated. When the member is used as an extrusion member, a member having a gradiently variable characteristics can be obtained which is suitable as the raw material in a new application field. In the production of metallic powder by rapidly solidification, both coarse powder and fine powder are inevitably produced, but the coarse powder which has been discarded as the low-grade material becomes worthwhile utilizing, thus making itself industrially advantageous.

What is claimed is:

1. A process for producing a billet of powdery alloys which comprises densely packing a powdery metal or alloy readily plastically deformable and then a powdery alloy difficult to plastically deform in that order in a can, sealing hermetically the can and thereafter degassing the can.

2. (amended) The process according to claim 1, wherein the powdery alloy difficult to plastically deform is a rapidly solidified powder alloy consisting of an amorphous phase, a microcrystalline phase or a mixed phase thereof.

3. (amended) The process according to claim 2, wherein the powdery alloy difficult to plastically deform is a rapidly solidified powder alloy consisting of one or more alloys selected from the group consisting of Al-base, Mgbase, Ni-base, Ti-base and Fe-base alloys.

4. (amended) The process according to claim 1, wherein the powdery metal or alloy readily plastically deformable and the powdery alloy difficult to plastically deform coexist gradiently with respect to the content thereof in a boundary thereof.

5. (amended) The process according to claim 1, wherein the powdery metal or alloy readily plastically deformable and the powdery alloy difficult to plastically deform are compacted after or during the degassification.

6. (amended) The process according to claim 1, wherein the powdery metal or alloy readily plastically deformable is in the form of coarse powder, while the powdery alloy difficult to plastically deform is in the form of fine powder.

7. (amended) A process for producing a billet of powdery alloys which comprises densely packing a powdery alloy difficult to plastically deform in a can and, then, densely packing a powdery metal or alloy readily plastically deformable in the can to make the powdery metal or alloy readily plastically deformable into a lid of the can.

8. The process according to claim 7, wherein the powdery alloy difficult to plastically deform is a rapidly solidified powder alloy consisting of an amorphous phase, a microcrystalline phase or a mixed phase thereof.

9. The process according to claim 8, wherein the powder alloy difficult to plastically deform is a rapidly solidified powder alloy consisting of one or more alloys selected from the group consisting of Al-base, Mgbase, Ni-base, Ti-base and Fe-base alloys.

10. (amended) The process according to claim 7, wherein after packing the powdery metal or alloy readily plastically deformable in the can, the can is heated and pressurized from the packing side of the powdery metal or alloy readily plastically deformable to densely maintain within the can the powdery alloy difficult plastically deform and the powdery metal or alloy readily plastically deformable.

11. The process according to claim 10, wherein the powdery alloy difficult to plastically deform is densely maintained, then degassed and further compacted.

12. The process according to claim 7, wherein the powdery metal or alloy readily plastically deformable is in the form of coarse powder, while the powdery alloy difficult to plastically deform is in the form of fine powder.

13. A process for producing an extruded article which comprises densely packing a powdery alloy difficult to plastically deform in a can and, then, densely packing a powdery metal or alloy readily plastically deformable in the can to make the powdery metal or alloy readily plastically deformable into a lid of the can, degassing and compacting to provide a billet and extruding the resultant billet from the side of the powdery metal or alloy readily plastically deformable.

14. The process according to claim 13, wherein the powdery alloy difficult to plastically deform is a rapidly solidified powder alloy consisting of an amorphous phase, a microcrystalline phase or a mixed phase thereof.

15. The process according to claim 8, wherein the powder alloy difficult to plastically deform is a rapidly solidified powder alloy consisting of one or more alloys selected from the group consisting of Al-base, Mgbase, Ni-base, Ti-base and Fe-base alloys.

16. The process according to claim 13, wherein after packing the powdery metal or alloy readily plastically deformable in the can, the can is heated and pressurized from the packing side of the powdery metal or alloy readily plastically deformable to densely maintain within the can the powdery alloy difficult plastically deform and the powdery metal or alloy readily plastically deformable.

17. The process according to claim 16, wherein the powdery alloy difficult to plastically deform is densely maintained, then degassed and further compacted.

18. The process according to claim 13, wherein the powdery metal or alloy readily plastically deformable is in the form of coarse powder, while the powdery alloy difficult to plastically deform is in the form of fine powder.

* * * * *

UNITED STATES PATENT AND TRADEMARK OFFICE

CERTIFICATE OF CORRECTION

PATENT NO. : 5,342,575

DATED : August 30, 1994

INVENTOR(S) : Yoshitaka NAGAI

It is certified that error appears in the above-indentified patent and that said Letters Patent is hereby corrected as shown below:

In the Abstract, Item [57], line 3, "easy of plastic working", should be corrected to read -- readily plastically deformable --;

line 4, "difficult of plastic working", should be corrected to read -- difficult to plastically deform --;

line 7, "difficult of plastic working", should be corrected to read -- difficult to plastically deform --;

line 9, "easy of plastic working", should be corrected to read -- readily plastically deformable --;

line 11, "easy of plastic working", should be corrected to read -- readily plastically deformable --;

line 12, "difficult of plastic working", should be corrected to read -- difficult to plastically deform --.

Claim 2, column 6, line 28, delete the word "(amended)".

Claim 3, column 6, line 33, delete the word "(amended)";

column 6, line 37, "Mgbase", should read -- Mg-base".

UNITED STATES PATENT AND TRADEMARK OFFICE

CERTIFICATE OF CORRECTION

PATENT NO. : 5,342,575

DATED : August 30, 1994

INVENTOR(S) : Yoshitaka NAGAI

It is certified that error appears in the above-indentified patent and that said Letters Patent is hereby corrected as shown below:

Claim 4, column 6, line 38, delete the word "(amended)".

Claim 5, column 6, line 43, delete the word "(amended)".

Claim 6, column 6, line 48, delete the word "(amended)".

Claim 7, column 6, line 54, delete the word "(amended)".

Claim 9, column 7, line 1, "Mgbase", should read -- Mg-base --.

Claim 10, column 7, line 3, delete the word "(amended)";
column 7, line 9, after "difficult", insert -- to --.

Claim 15, column 8, line 9, "Mgbase", should read -- Mg-base --.

UNITED STATES PATENT AND TRADEMARK OFFICE

CERTIFICATE OF CORRECTION

PATENT NO. : 5,342,575

DATED : August 30, 1994

INVENTOR(S) : Yoshitaka NAGAI

It is certified that error appears in the above-indentified patent and that said Letters Patent is hereby corrected as shown below:

Claim 16, column 8, line 16, after "difficult", insert --to--.

Signed and Sealed this

Thirteenth Day of December, 1994

Bruce Lehman

*Attest:*

BRUCE LEHMAN

*Attesting Officer*

*Commissioner of Patents and Trademarks*